US006169380B1

(12) United States Patent
Gleichauf et al.

(10) Patent No.: US 6,169,380 B1
(45) **Date of Patent: *Jan. 2, 2001**

(54) ACQUISITION OF PRINTED MEDIA WITH DEFINED TRACTION

(75) Inventors: Markus Gleichauf, Blumberg; Elmar Speck, Boettingen; Andreas Stadler, Donaueschingen, all of (DE)

(73) Assignee: BDT Buro-und Datentechnik, GmbH & Co. KG, Rottweil (DE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/178,033

(22) Filed: Oct. 22, 1998

(30) Foreign Application Priority Data

Oct. 24, 1997 (DE) ..... 197 47 062

(51) Int. Cl.[7] ..... H02P 7/00

(52) U.S. Cl. ..... 318/432; 318/433; 318/434

(58) Field of Search ..... 318/432, 433, 318/434, 685

(56) References Cited

U.S. PATENT DOCUMENTS 4,980,623 * 12/1990 Anton ..... 318/432
5,205,548 * 4/1993 Yamada et al. ..... 271/3
5,838,132 * 11/1998 Tanaka ..... 318/685
5,971,388 * 10/1999 Hattori et al. ..... 271/10.03

* cited by examiner

*Primary Examiner*—Robert E. Nappi
*Assistant Examiner*—Rita Leykin
(74) *Attorney, Agent, or Firm*—Bernard L. Kleinke; Foley & Lardner

(57) ABSTRACT

The task of the invention comprises reliably acquiring documents from an output device with variable output speed without impermissible tractive forces being exerted onto the documents. For this purpose the rotational speed of the transport system of the acquisition unit is determined under no-load condition and the torque of the drive is reduced, for example by current imitation, until the transport rate of the acquisition unit is just above the maximum occurring transport rate of the output device. The torque value thus determined, which represents the torque requirement for overcoming the friction of the system, is stored and set as the nominal value during the document acquisition. As a drive motor can be used DC current motors as well as also load-controlled electronically commutated motors.

7 Claims, 4 Drawing Sheets

ACQUISITION OF PRINTED MEDIA WITH DEFINED TRACTION

CROSS-REFERENCE TO RELATED APPLICATIONS

This applications based on co-pending priority German Patent Application 19747062.9-53, which is incorporated herein by reference.

STATEMENT REGARDING FEDERALLY SPONSORED RESEARCH OR DEVELOPMENT

Not Applicable.

REFERENCE TO A "MICROFICHE APPENDIX"

Not Applicable.

BACKGROUND OF THE INVENTION

1. Technical Field

The invention relates to the control conception for an acquisition unit of printed media (documents) for detecting and regulating friction internal to the device. The acquisition unit is largely adapted to printers and copiers which output the printed media at different or varying rates.

2. Background Art

In the postpublished DE 196 33 740 A1 a process is described in which documents output by an output device are acquired by an acquisition unit for deposition in sorted form.

The core of the described process is that via a defined motor moment for the transport roller system of the acquisition unit a traction is exerted onto the documents as long as these are within the transport system of transfer and acquisition unit.

One disadvantage in this process is that the friction conditions in the transport system can have a strong effect on the resulting traction of the document during the acquisition. The motor moment of the acquisition unit must be selected to be such that at maximum friction the document is still transported reliably. If the friction in a device is very low, at given motor torque a high traction on the document results therefrom so that it is possible that the documents may be pulled out of the output device.

In the unpublished German Patent Application 197 33 697.3 a curvature is forced onto the entering document based on which the paper speed of the entering document can be derived. In this solution only the reset force of the sensor which detects the degree of curvature acts onto the traction of the document. The disadvantage in this process is the complex and expensive construction of the run-in region as well as the expenditures for the additionally required sensor system.

From DE 26 42 818 A1 is known an arrangement for transporting documents comprising a document transport device which exerts traction onto the documents.

SUMMARY OF THE INVENTION

The object of the invention is keeping the traction on the documents low or within defined limits.

The task of the invention comprises reliably acquiring documents from an output device such as a printer or a copier, with variable output speed without impermissible tractive forces being exerted onto the documents. For this purpose the rotational speed of the transport system of the acquisition unit is determined under no-load condition and the torque of the drive is reduced, for example by current imitation, until the transport rate of the acquisition unit is just above the maximum occurring transport rate of the output device. The torque value thus determined, which represents the torque requirement for overcoming the friction of the system, is stored and set as the nominal value during the document acquisition. As a drive motor can be used DC current motors as well as also load-controlled electronically commutated motors.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

The invention will be explained in further detail in conjunction with the drawings FIG. 1 to FIG. 4 with reference to an embodiment example.

BEST MODE FOR CARRYING OUT THE INVENTION

Figure 1:
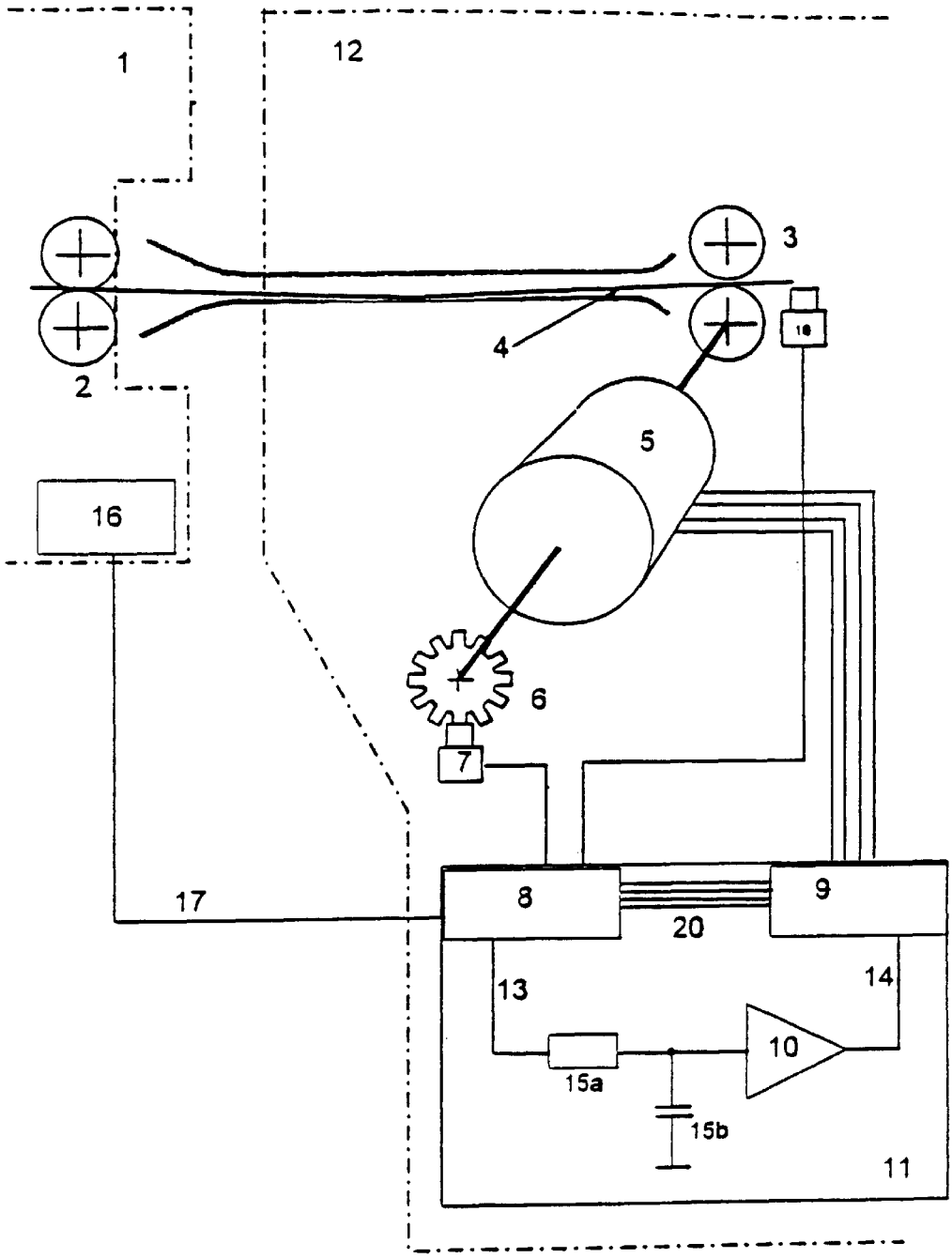
FIG. 1. As a functional block diagram of a fundamental configuration of the components of the transfer and the acquisition device of the present invention.

For a document acquisition device which is intended for printers and copiers with different document output rates, an acquisition unit is to be developed which adapts automatically to the different speeds. The speeds can change between different documents as well as also within one document. The range of document speeds fluctuates therein between 29 mm/s and 154 mm/s. The goal is to limit the traction on the document to 0.5 N.

To solve this requirement the transport rollers of the transport system (3) of the acquisition unit (12) are driven with a stepping motor (drive motor) (5) which is equipped with an encoder (6 and 7). From the encoder signal data regarding speed as well as also rotor position can be derived. This makes it possible to carry out the commutation of the phase currents under load control. If the nominal speed of the transport system (3) is equal to or greater than the speed of the output unit (1), the transport system (3) of the acquisition unit (12) can be decelerated to this speed without step loss. The torque of the stepping motor (5), and thus the traction on the document, can be varied by limiting the phase current in the driver stage (9). Tolerances in the stepping motor (5) and the transport system (3), due to the effects of fabrication and environment, however, become effective as a change of the document traction. In order to keep the traction within the requisite narrow limits, it is necessary to take these tolerances into consideration which are primarily caused by fluctuations of the friction losses in the drive system (19).

Figure 2A:
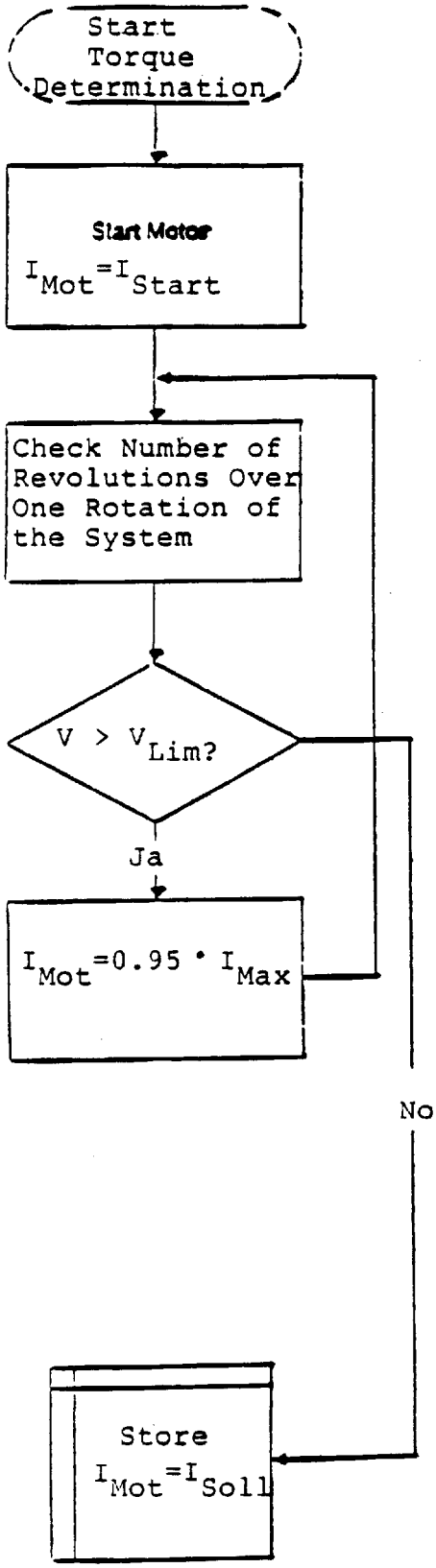
FIG. 2. Is a flow chart diagram of the program flow for determining the current requirement to overcome the friction and the acquisition of a document from the output device.

Determination of the friction can be carried out after the system is switched on or before a document is fed. A message about an arriving document is sent by the output unit (1) via a communication line (17) to the acquisition unit. After this message, the micro controller (8) starts the stepping motor with the current value $I_{start}$. This current value must be selected such that a system even at the highest occurring friction reaches reliably a rotational speed which is above the maximum document speed. The resulting speed of the drive motor (5) is detected via the encoder (6 and 7) and a message regarding the speed is sent to the microcontroller (8). As can be seen in the flow chart FIG. 2*a,* the speed is compared to a limit value which must be equal to or slightly greater than the highest occurring document speed of the output device. As long as the instantaneous value of the speed is greater than the limit value, the motor current is decreased in steps. This process is repeated until the speed is no longer above the selected limit value. With this current value the motor generates a torque which is barely necessary to drive the acquisition unit at the predetermined speed and thus maintains the tractions on the documents within narrow limits.

The nominal value of the motor current is impressed by the microcontroller (8) via a pulse width-modulated signal (13). The signal is converted by means of a lowpass (15*a* and 15*b*) into an analog signal, amplified in the amplifier (10) and supplied to the motor driver stage (9). The resolution of the current stages in this application case was selected at 5% of the maximum current. This resolution must be adapted depending on the digital-to-analog converter (15*a* and 15*b*) used and the available time between document announcement and document output. It is necessary to ensure conceptually that the time between announcing a document and reaching the transport system (3) is sufficient to reach the limit speed. If the document reaches the transport system before then, the system is decelerated below the limit speed through the document and false friction conditions are pretended to exist. This leads to the acquisition of the acquisition document at impermissibly high traction. If no large fluctuations are expected between the individual documents, it is recommended to select a higher start value of the current when the system is switched on than between the individual documents. As a function of the previously set current value, the next start value is selected to be higher by a specific factor. With this measure the number of necessary current reduction steps to reach the limit speed can be decreased for applications in which time is critical.

Figure 2B:
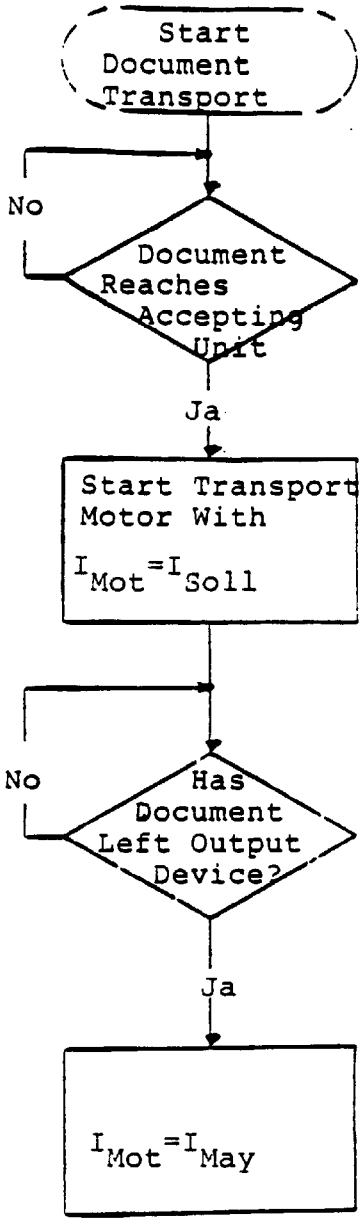

The determined current value is stored and set during the document acquisition (FIG. 2*b*). When the document reaches the transport system (3) of the acquisition unit (12), its speed is decelerated to the document speed of the output unit (1). The resulting traction therein depends on the motor employed and the rotational speed difference.

For the reliable transport of the documents, the current of the stepping motor (5) must be increased as soon as the document has left the transport system (2) of the output unit (1). This point in time can be determined via the communication line (17) or, where the size of the document is known, via a sensor (18) in the document path of the acquisition unit (12).

Figure 3A:
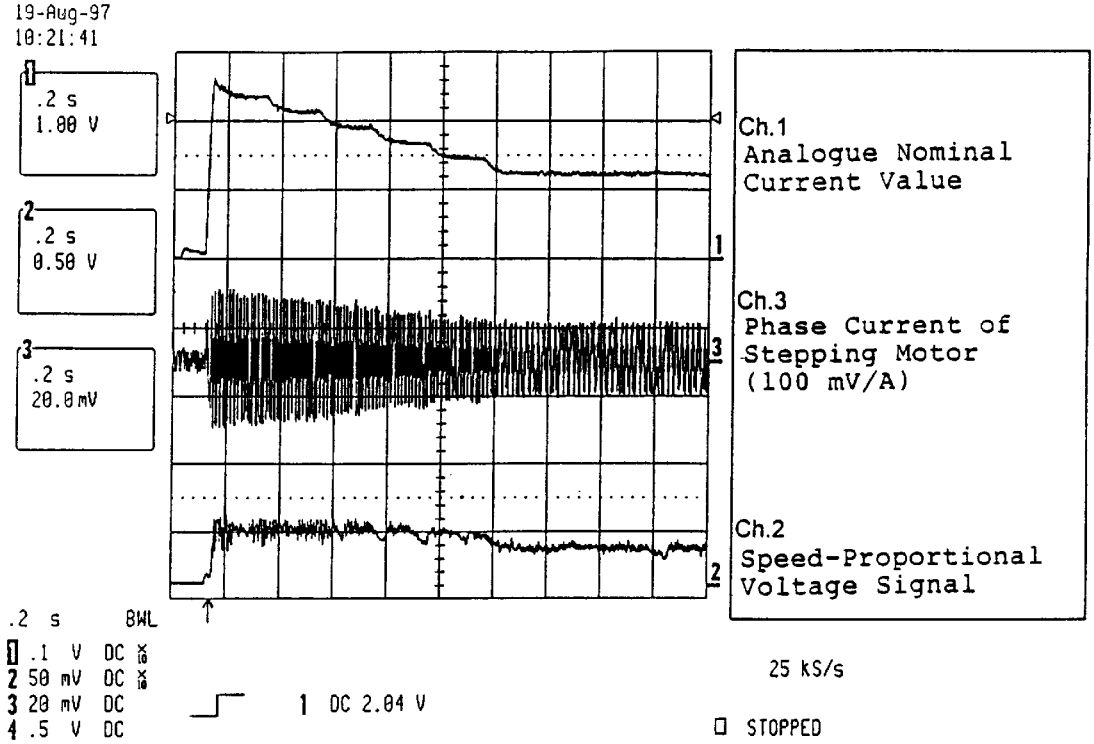
FIGS. 3*a* and 3*b*. Are graphs of oscillogram traces which illustrate the trace of the motor current in a winding of the stepping motor, the nominal current value and the speed of the transport system at a friction of 100% (3*a*) or approximately 200% (3*b*) during the determination of the torque.
Figure 3B:
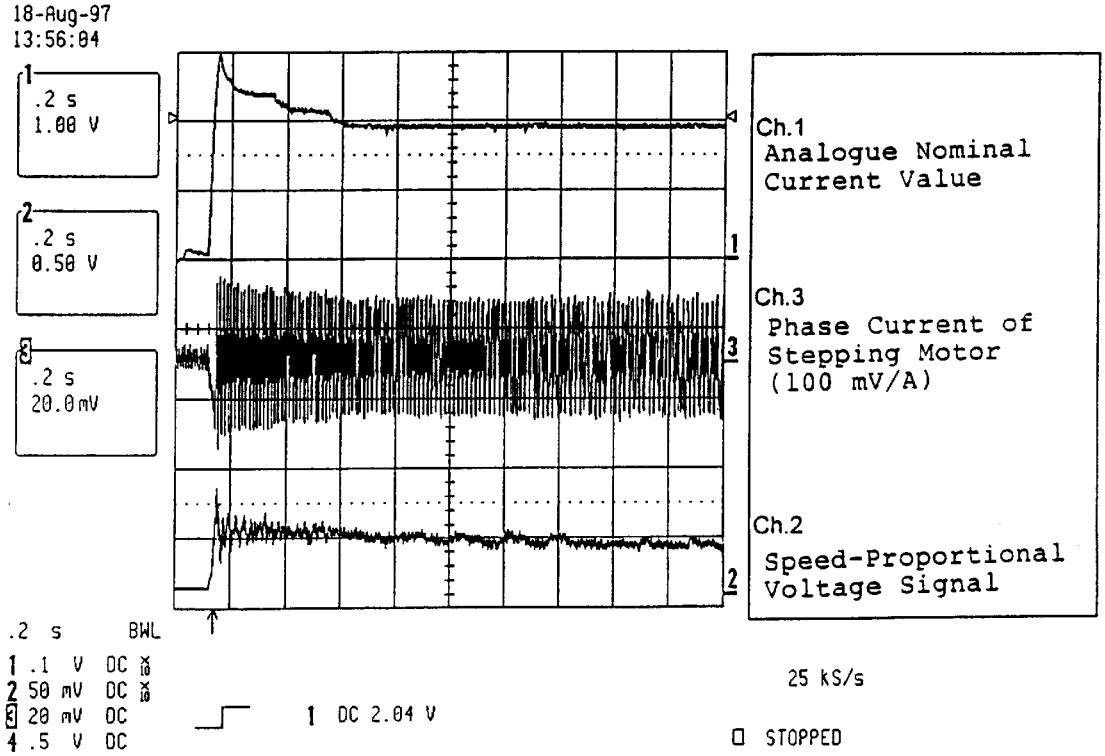

The oscillogram FIG. 3*a* and 3*b* were recorded with the realized application example and show the step-wise current reduction for the determination of the necessary current requirement at different frictional conditions in the acquisition unit. In FIG. 3*b* the friction in the transport system (3) was artificially increased by the factor 2 in comparison to FIG. 3*a*. In order to keep the kinetic energy in the transport system low, the stepping motor is driven at the beginning of the setting process at a current-independent speed. The microcontroller (8) under time control presents the phase change of the stepping motor (5). The selected speed must therein be at least equal to or greater than the limit speed $V_{lim}$. The voltage signal proportional to the speed is therefore only decreased toward the end of the setting process.

Figure 4:
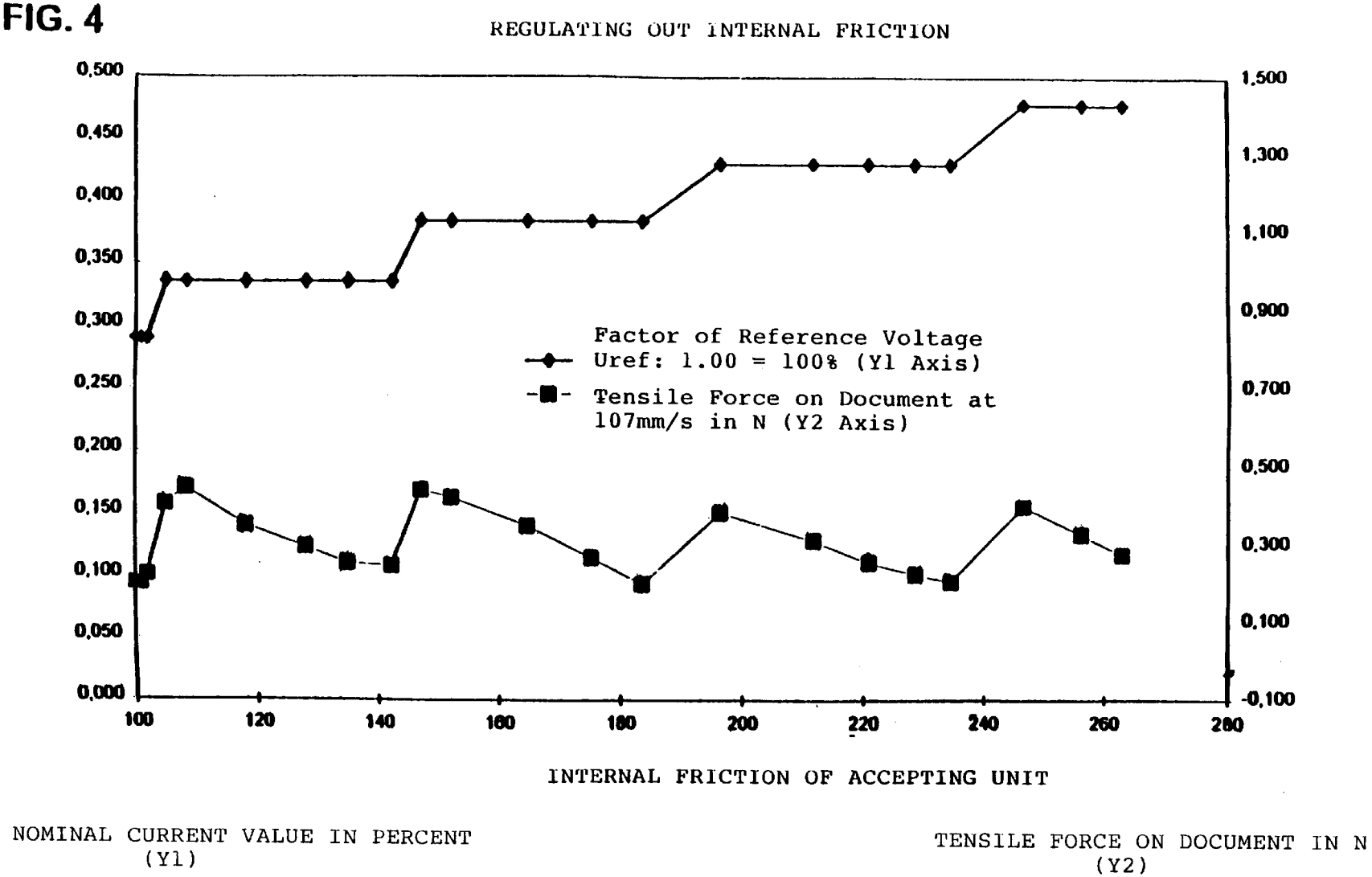
FIG. 4. A graph illustrating measuring series in which the described concept for regulating the friction is employed. On the X-axis is plotted the percentage value of the artificially influenced friction. On the Y-axis is plotted the effective traction on the document as well as the nominal current value signal.

FIG. 4 represents the variation of the document tractions as well as the nominal value of the motor current at different mechanical friction values in the transport system (3). The document traction is generated by that portion of the motor torque which is not required for overcoming the friction. Therefore, the traction decreases with increasing friction within a current stage. The fluctuations between minimum and maximum document traction depend on the gradation of the current values. A finer resolution of the current stages leads to a decrease of these fluctuations.

While particular embodiments of the present invention have been disclosed, it is to be understood that various different modifications are possible and are contemplated within the true spirit and scope of the appended claims. There is no intention, therefore, of limitations to the exact abstract or disclosure herein presented. Also, the accompanying Appendix A is a listing of abbreviations and references symbols useful in understanding the present invention.

Abbreviations and Reference Symbols

1 Document output device
2 Transport system of output device
3 Transport system of document acquisition device
4 Device
5 Drive motor of acquisition device
6 Clock wheel for rotational speed and rotor position recognition (Encoder)
7 Sensor system for rotational speed and rotor position detection (Encoder)
8 Microcontroller
9 Motor driver stage with current regulation
10 Amplifier
11 Electronic component of document acquisition device
12 Document acquisition device
13 Digital nominal current value signal
14 Analog nominal current value signal
15*a* Lowpass [filter] for the digital-to-analog conversion and 15*b*
16 Electronic component of document transfer device
17 Communication line
18 Sensor in document path of acquisition unit
19 Transmission element between motor and transport rollers
20 Digital phase signals for stepping motor control
$I_{mot}$ Motor current
$I_{max}$ Maximum permissible constant motor current
$I_{sell}$ Nominal value of motor current
$I_{start}$ Output current value for torque determination
V Transport speed of acquisition device
$V_{lim}$ Limit value of transport speed of acquisition device

What is claimed is:

1. Acquisition device with an acquisition transport system driven by a stepping motor for acquisition of documents delivered by an output transport system of an output device, comprising:

(a) means for starting the stepping motor under no-load condition with a current value $I_{Start}$ selected such that the acquisition transport system reaches a rotational speed which is above a known maximum document speed of the output transport system;

(b) means for detecting the speed of the acquisition transport system and decreasing motor current as long as the instantaneous speed of the acquisition transport system is greater than said maximum document speed;

(c) means for storing the limit value of motor current at which the speed of the acquisition transport system is equal to said maximum document speed;

(d) means for reducing the motor current to said stored limit value each time before a document delivered by the output transport system reaches the acquisition transport system; and (e) means for increasing the motor current again when said document has left the output transport system.

2. Arrangement as claimed in claim 1, wherein the torque of the stepping motor of the acquisition transport system is variable through a current control.

3. Arrangement as claimed in claim 1, wherein the transport speed of the acquisition transport system can be detected through at least one sensor.

4. Arrangement as claimed in claim 1, wherein through the stepwise reduction of the motor current the speed of the free-running acquisition transport system is matched to the speed of the output device.

5. Arrangement as claimed in claim 1, wherein the value of the motor current set can be stored and remains constant during the document acquisition.

6. Arrangement as claimed in claim 4, wherein the stepwise reduction of the motor current is repeated cyclically so that changes at the acquisition transport system can be detected.

7. A method utilizing an acquisition transport system driven by a stepping motor for acquisition of documents delivered by an output transport system of an output device, comprising:

(a) starting the stepping motor under no-load condition with a current value $I_{Start}$ selected such that the acquisition transport system reaches a rotational speed which is above a known maximum document speed of the output transport system;

(b) detecting the speed of the acquisition transport system and decreasing motor current as long as the instantaneous speed of the acquisition transport system is greater than said maximum document speed;

(c) storing the limit value of motor current at which the speed of the acquisition transport system is equal to said maximum document speed;

(d) reducing the motor current to said stored limit value each time before a document delivered by the output transport system reaches the acquisition transport system; and (e) increasing the motor current again when said document has left the output transport system.

* * * * *

UNITED STATES PATENT AND TRADEMARK OFFICE

CERTIFICATE OF CORRECTION

PATENT NO : 6,169,380 Bl

DATED : January 2, 2001

INVENTOR(S) : Markus Gleichauf

It is certified that error appears in the above-identified patent and that said Letters Patent is hereby corrected as shown below:

Column 2, line 45 before "printers"---insert "output devices such as"

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*